US008105446B2

(12) United States Patent
Shintani et al.

(10) Patent No.: US 8,105,446 B2
(45) **Date of Patent: *Jan. 31, 2012**

(54) PROCESS FOR PRODUCING ALLOY SLAB FOR RARE-EARTH SINTERED MAGNET, ALLOY SLAB FOR RARE-EARTH SINTERED MAGNET AND RARE-EARTH SINTERED MAGNET

(75) Inventors: Kazumasa Shintani, Glendale, AZ (US); Ryo Murakami, Yokohama (JP); Kazuhiko Yamamoto, Kobe (JP)

(73) Assignee: Santoku Corporation, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/756,689

(22) Filed: Apr. 8, 2010

(65) Prior Publication Data

US 2010/0200121 A1 Aug. 12, 2010

Related U.S. Application Data

(63) Continuation of application No. 10/599,482, filed as application No. PCT/JP2005/006278 on Mar. 31, 2005, now Pat. No. 7,722,726.

(30) Foreign Application Priority Data

Mar. 31, 2004 (JP) ..... 2004-103262
May 28, 2004 (JP) ..... 2004-160357

(51) Int. Cl.
*H01F 1/057* (2006.01)

(52) U.S. Cl. ..... 148/302; 148/101; 148/121

(58) Field of Classification Search ..... None
See application file for complete search history.

(56) References Cited

U.S. PATENT DOCUMENTS

| | | | |
|---|---|---|---|
| 5,665,177 | A | 9/1997 | Fukuno et al. |
| 6,536,507 | B1 | 3/2003 | Arai et al. |
| 6,554,913 | B2 | 4/2003 | Arai et al. |
| 7,014,718 | B2 | 3/2006 | Hasegawa et al. |
| 2002/0023697 | A1 | 2/2002 | Arai et al. |
| 2002/0028334 | A1 | 3/2002 | Arai et al. |
| 2002/0053372 | A1 | 5/2002 | Arai et al. |
| 2002/0066498 | A1 | 6/2002 | Arai et al. |
| 2003/0217788 | A1 | 11/2003 | Arai et al. |
| 2004/0245491 | A1 | 12/2004 | Arai et al. |
| 2005/0028892 | A1 | 2/2005 | Sasaki |

FOREIGN PATENT DOCUMENTS

| | | | |
|---|---|---|---|
| EP | 0 801 402 | B1 | 10/1997 |
| JP | 05-222488 | A | 8/1993 |
| JP | 05-269549 | A | 10/1993 |
| JP | 08-269643 | A | 10/1996 |
| JP | 09-170055 | A | 6/1997 |
| JP | 10-036949 | A | 10/1998 |
| JP | 2002-050507 | A | 2/2002 |
| JP | 2004-043921 | A | 2/2004 |
| WO | 02/072900 | | 9/2002 |

*Primary Examiner* — John Sheehan
(74) *Attorney, Agent, or Firm* — Sughrue Mion, PLLC

(57) ABSTRACT

Disclosed are a method for producing alloy flakes for rare earth sintered magnets, which makes uniform the intervals, size, orientation, and shape of the R-rich region and the dendrites of the 2-14-1 phase, and alloy flakes for a rare earth sintered magnet obtained by the method. A rare earth sintered magnet employing the alloy flakes is also disclosed.

4 Claims, 9 Drawing Sheets

Fig. 8
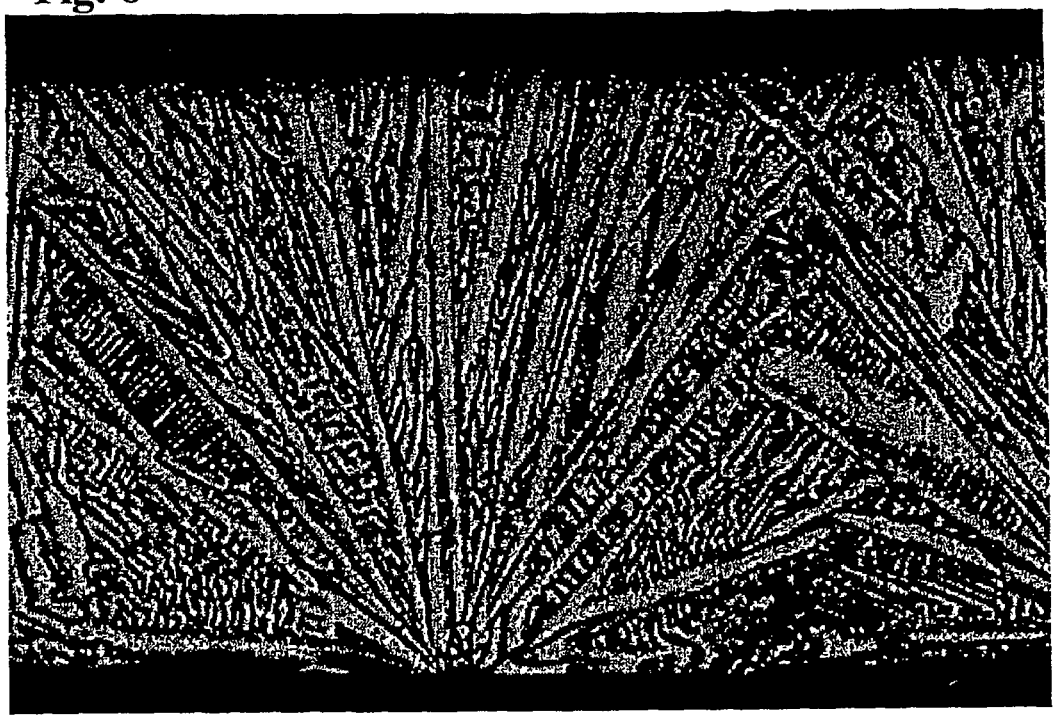
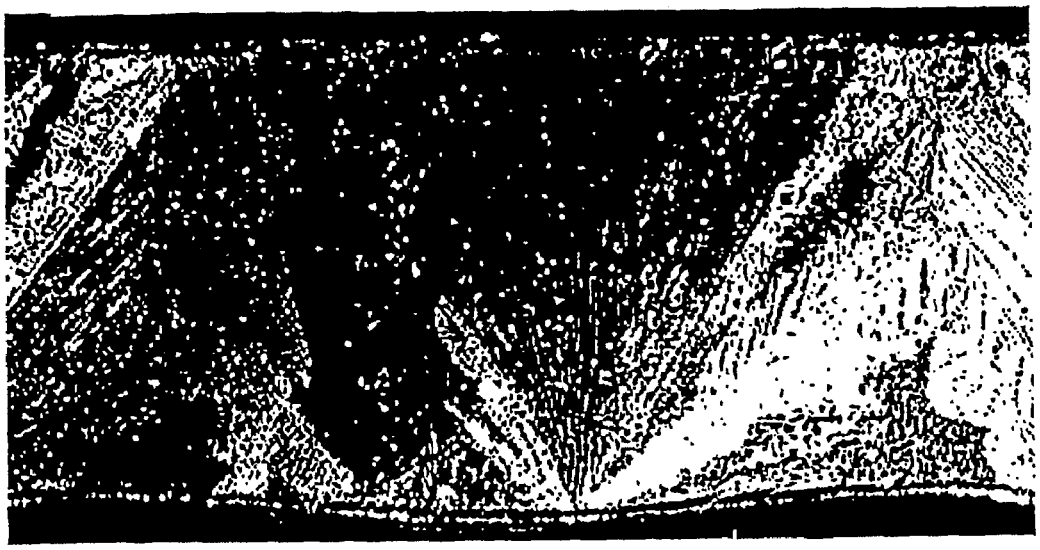
Fig. 9

Fig. 10
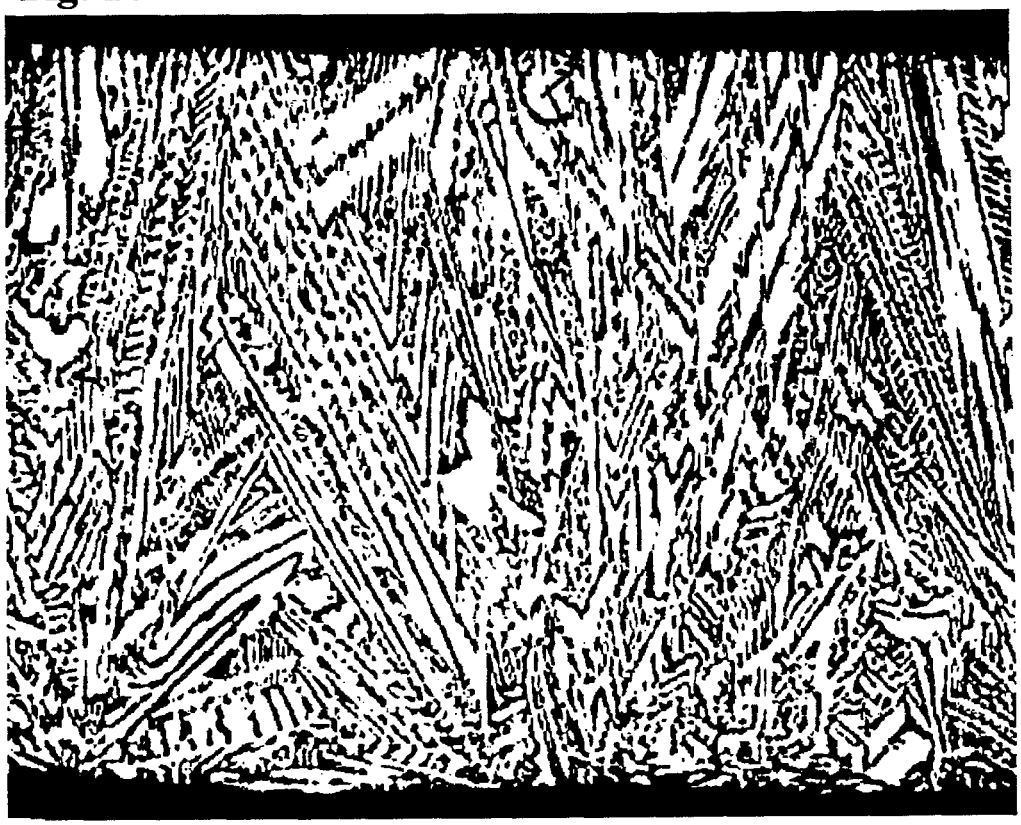
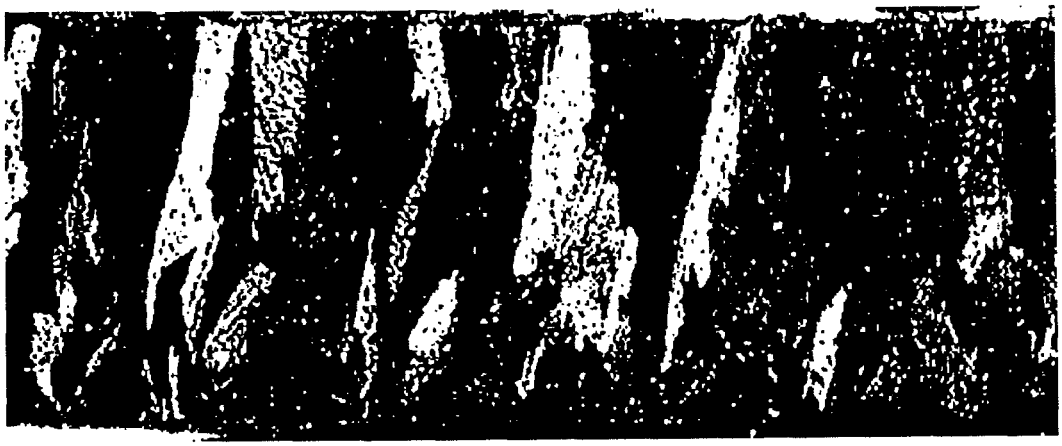
Fig. 11

Fig. 12
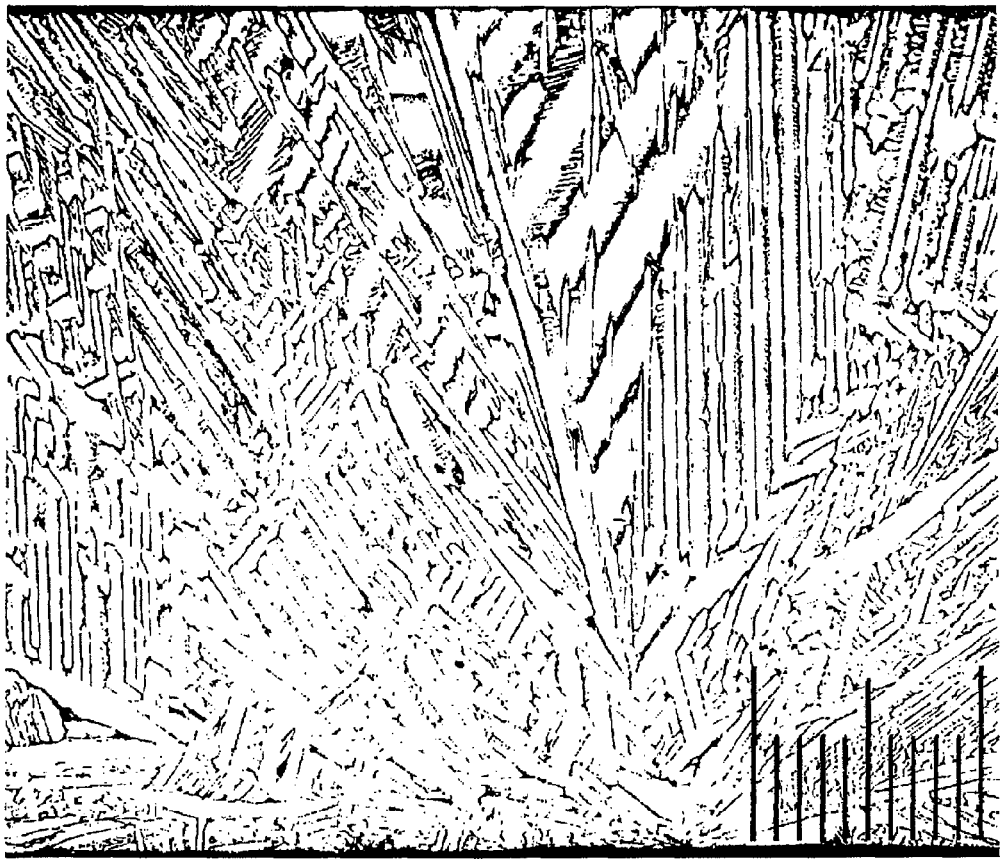
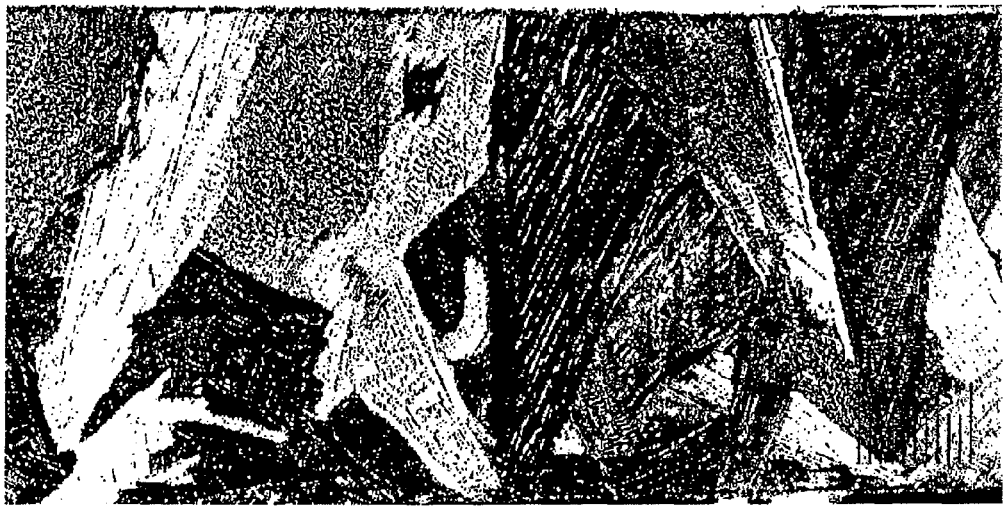
Fig. 13

Fig. 14
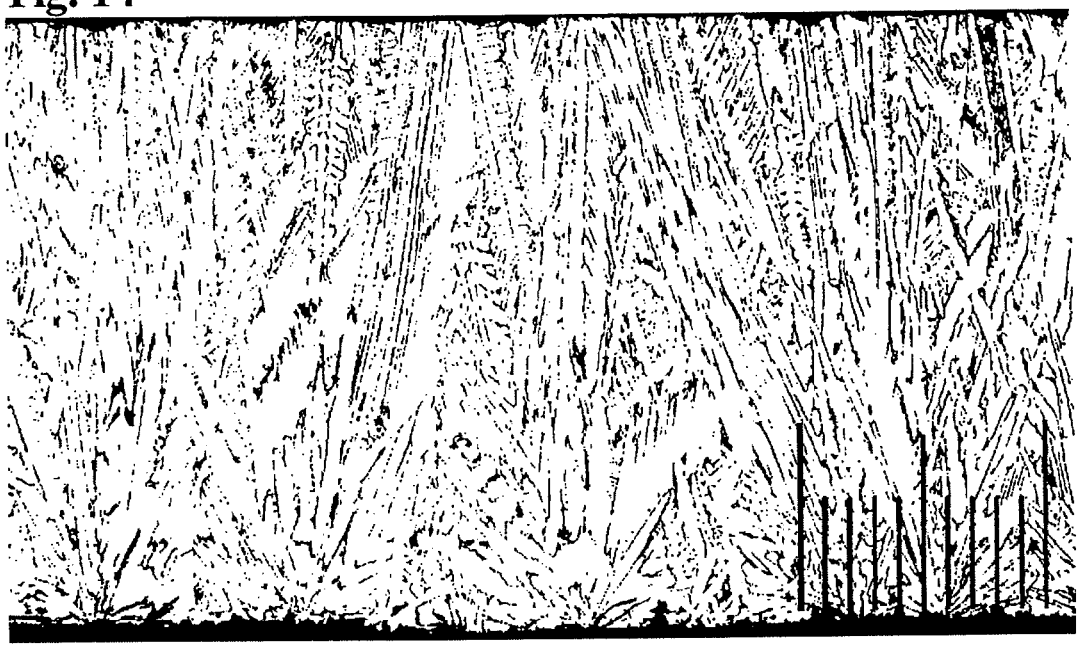
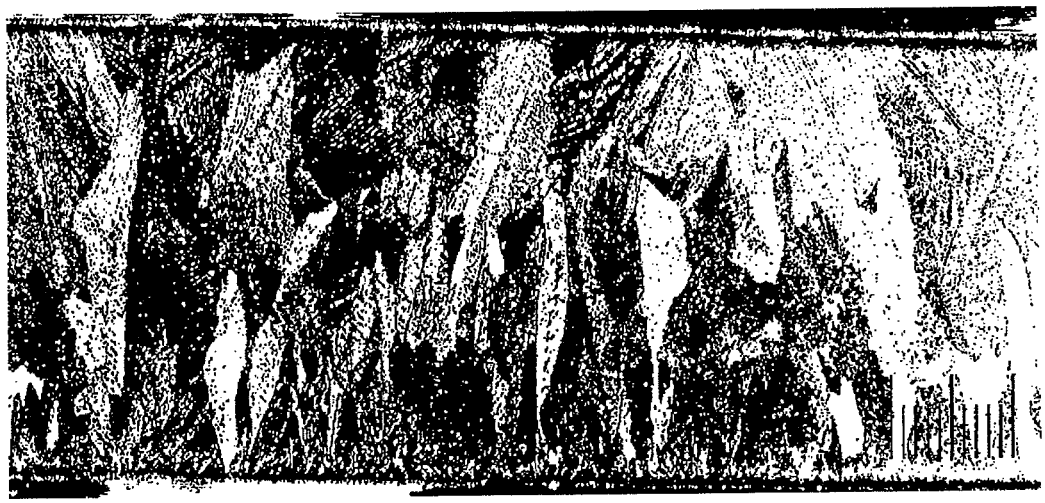
Fig. 15

PROCESS FOR PRODUCING ALLOY SLAB FOR RARE-EARTH SINTERED MAGNET, ALLOY SLAB FOR RARE-EARTH SINTERED MAGNET AND RARE-EARTH SINTERED MAGNET

FIELD OF ART

The present invention relates to a method for producing alloy flakes for a rare earth sintered magnet, particular alloy flakes for a rare earth sintered magnet obtained by this method, and a rare earth sintered magnet produced from the alloy flakes.

BACKGROUND ART

Downsizing and weight-saving of electronic equipment requires higher magnetic properties of the magnets used therein. In particular, active development has been made of $R_2Fe_{14}B$ type rare earth sintered magnets, which have a high magnetic flux density. Such $R_2Fe_{14}B$ type rare earth sintered magnets are generally produced by melting and casting the starting materials, pulverizing the resulting magnet material alloy, compacting the pulverized alloy in a magnetic field, followed by sintering and ageing.

The raw material alloy for $R_2Fe_{14}B$ type rare earth sintered magnets usually contains dendrites of a $R_2Fe_{14}B$ phase (sometimes referred to as a 2-14-1 phase hereinbelow) and a region of a phase with a relatively low melting point having a higher rare earth metal content than the 2-14-1 phase (sometimes referred to as an R-rich region hereinbelow). In the production of $R_2Fe_{14}B$ type rare earth sintered magnets, when the raw material alloy is sintered, the R-rich region melts into a liquid phase and fills gaps between the grains of the 2-14-1 phase, to thereby improve the sinterability and contribute to densification of the resulting sintered product. When solidified, the non-magnetic R-rich region coats the grains of the ferromagnetic 2-14-1 phase to magnetically insulate the 2-14-1 phase and improve the coercivity.

For producing a raw material alloy for such sintered magnets, there is conventionally known a method for casting an alloy having a structure with finely dispersed R-rich region, by rapid solidification, such as strip casting (Patent Publication 1).

Patent Publication 1 discloses that the raw material alloy wherein the R-rich region is finely dispersed, has good pulverizability, and as a result, the grains of the 2-14-1 phase are uniformly coated with the R-rich region after sintering, which improves the magnetic properties.

Patent Publication 2 teaches that microscopic analysis of the crystal structure of alloy flakes indicates that fine dendritic or columnar crystals in the flakes have an impact on oxidation in finely pulverizing the flakes into magnet powders and on decrease in the degree of orientation of the resulting sintered magnet. In order to reduce the fine dendritic or columnar crystals, this publication proposes a method of producing a raw magnet alloy including controlling the temperature of the alloy melt in rapid solidification, the primary cooling rate on a cooling roll, and the secondary cooling rate after the flakes are separated from the cooling roll.

Patent Publications 3 and 4 disclose that the magnetic remanence is improved by increasing the volume ratio of the 2-14-1 phase in the raw material alloy, reducing the intervals between the R-rich regions, and increasing the crystal grain size in the alloy structure, and that, as an example, a preferred alloy has an average crystal grain size of 10 to 100 μm, and intervals between the R-rich regions of 3 to 15 μm. The publications also disclose that such a raw material alloy may be produced by controlling the primary cooling rate in the rapid solidification, the secondary cooling rate, and the temperature of heat treatment.

By increasing the primary cooling rate, the intervals between the R-rich regions are reduced, and the crystal grain size is also reduced, whereas by reducing the primary cooling rate, the intervals between the R-rich regions are increased, and the crystal grain size is also increased. On the other hand, by controlling the secondary cooling rate, i.e. by decreasing the cooling rate after solidification, the intervals between the R-rich regions may be increased under certain conditions.

However, mere control of the primary and secondary cooling rates and the heat treatment cannot achieve both increase in ratio of the dendrites of the 2-14-1 phase and prevention of the chill crystal formation at the same time. Further, increase in the crystal grain size is limited and the desired crystal grain size cannot be achieved.

With regard to the cooling roll, Patent Publication 5 discloses a cooling roll having gas channels formed thereon as ventilating means. The width of the gas channels disclosed in Examples is 20 μm or less, and the alloy intended to be produced with the roll has an amorphous or microcrystalline structure. Patent Publication 5 does not even imply that, using such a cooling roll, alloy flakes may be produced which have the alloy structure containing the R-rich region and the dendrites of the 2-14-1 phase with the dendrite content of not lower than 80 vol %.

Patent Publication 6 discloses a cooling roll having grooves circumferentially extending in the Cr surface layer, wherein the average distance between the grooves is 100 to 300 μm in an arbitrary sectional surface containing the shaft, the peaks and troughs in a cross section of the grooves are smoothly connected, the mean center line roughness is 0.07 to 5 μm, and the depth of the grooves is 1 to 50 μm. The peaks and troughs of the grooves are smoothly connected so as to configure the grooves to expand the surface area of the cooling roll, and allow entry of the alloy melt also into the troughs of the grooves to improve the contact between the alloy melt and the roll. Thus using this cooling roll, alloy flakes cannot be obtained having the alloy structure wherein the chill crystal content is suppressed and the intervals and size of dendrites are uniform.

Patent Publication 7 discloses to produce alloy flakes for a rare earth sintered magnet, using a cooling roll which has a plurality of linear convexes and concaves crossing with each other in the surface of the roll, and has a ten-point mean roughness of not lower than 3 μm and not higher than 30 μm. Such convexes and concaves may inhibit random formation of an area wherein the R-rich region is extremely fine (fine R-rich region) on the side of the cooling roll. However, using this cooling roll, alloy flakes cannot be obtained which have the alloy structure containing the R-rich region and the dendrites of the 2-14-1 phase with the dendrite content of not lower than 80 vol %, and have uniform intervals and size of the dendrites.

Patent Publication 1: JP-5-222488-A
Patent Publication 2: JP-8-269643-A
Patent Publication 3: JP-9-170055-A
Patent Publication 4: JP-10-36949-A
Patent Publication 5: JP-2002-50507-A
Patent Publication 6: JP-5-269549-A
Patent Publication 7: JP-2004-43921-A

SUMMARY OF THE INVENTION

It is an object of the present invention to provide a method for producing alloy flakes for a rare earth sintered magnet, which may make the intervals, size, orientation, and shape of the R-rich region and the dendrites of the 2-14-1 phase as uniform as possible, which may inhibit formation of chill crystals, and which produces alloy flakes that may be pulverized into powder of a uniform particle size in the pulverization step in the production of a rare earth sintered magnet, and that may be pulverized into alloy powder compactable into a product with a controlled shrink ratio.

It is another object of the present invention to provide alloy flakes for a rare earth sintered magnet obtained by the method of the present invention, which may easily be pulverized into powder of a uniform particle size in the pulverization step in the production of a rare earth sintered magnet, which powder is compactable into a product with a controlled shrink ratio, which have a low chill crystal content, and which contains crystal grains with a large average size including an R-rich region and dendrites of a 2-14-1 phase.

It is yet another object of the present invention to provide an $R_2Fe_{14}B$ type rare earth sintered magnet prepared from the alloy flakes of the present invention and having excellent magnetic properties.

The present inventors have found out that, by controlling the position as well as the number of nuclei formed in an alloy melt, the alloy structure of the resulting alloy flakes, such as the sizes of the R-rich region and the dendrites of a 2-14-1 phase, may be made uniform, and that by controlling the position of nucleation on the surface of a cooling roll in producing alloy flakes, the above problems may be solved, and alloy flakes may be obtained in which formation of chill crystals is inhibited, and which are suitable as a raw material for rare earth sintered magnets, to thereby complete the present invention.

According to the present invention, there is provided a method for producing alloy flakes for a rare earth sintered magnet of an alloy structure containing an R-rich region and dendrites of a $R_2Fe_{14}B$ phase with a dendrite content of not lower than 80 vol %, said method comprising the steps of:

(A) preparing an alloy melt of a composition consisting of R of at least one element selected from the group consisting of rare earth metal elements including yttrium, boron, and the balance M including iron, and (B) supplying and solidifying said alloy melt prepared in step (A) on a cooling roll, wherein said cooling roll has on its roll surface a plurality of linear nucleation inhibiting portions for inhibiting formation of dendrites of a $R_2Fe_{14}B$ phase and chill crystals, and a plurality of nucleating portions for formation of said dendrites, and wherein said linear nucleation inhibiting portions have a region with a width of more than 100 μm.

According to the present invention, there is also provided alloy flakes for a rare earth sintered magnet obtained by the above method, comprising R of at least one element selected from the group consisting of rare earth metal elements including yttrium, boron, and the balance M including iron, and having an alloy structure containing an R-rich region and dendrites of a $R_2Fe_{14}B$ phase with a dendrite content of not lower than 80 vol % and a chill crystal content of not higher than 1 vol %, wherein an average size of crystal grains including said R-rich region and said dendrites of the $R_2Fe_{14}B$ phase in the alloy structure is not smaller than 40 μm.

According to the present invention, there is further provided a rare earth sintered magnet obtained by pulverizing, compacting, sintering, and ageing a raw material alloy comprising the above alloy flakes for a rare earth sintered magnet.

The method for producing alloy flakes for a rare earth sintered magnet according to the present invention includes steps (A) and (B) mentioned above, and specifically a particular cooling roll is used in step (B), so that alloy flakes may be produced efficiently, which are suitable as a raw material for rare earth sintered magnets, and which have an alloy structure wherein the intervals, size, orientation, shape, and the like of the R-rich region and the dendrites of the 2-14-1 phase are made as uniform as possible, wherein the dendrite content is not lower than 80 vol %, and wherein the chill crystal content is suppressed. Since the alloy flakes according to the present invention have a uniform alloy structure as mentioned above, the alloy flakes may easily be pulverized into powder of a uniform grain size in the pulverization step in the production of rare earth sintered magnets, and when the pulverized alloy powder is compacted and sintered, the shrink ratio of the resulting compacted product may be controlled. Thus, by using such alloy flakes, rare earth sintered magnets having excellent magnet properties may be provided.

BRIEF DESCRIPTION OF THE DRAWINGS

FIG. 8 is a micrograph of the structure of the alloy flakes for a rare earth sintered magnet prepared in Example 2, taken under an optical microscope.

FIG. 9 is a micrograph of the structure of the alloy flakes for a rare earth sintered magnet prepared in Example 2, taken under a polarization microscope.

FIG. 10 is a micrograph of the structure of the alloy flakes for a rare earth sintered magnet prepared in Comparative Example 1, taken under an optical microscope.

FIG. 11 is a micrograph of the structure of the alloy flakes for a rare earth sintered magnet prepared in Comparative Example 1, taken under a polarization microscope.

FIG. 12 is a micrograph of the structure of the alloy flakes for a rare earth sintered magnet prepared in Referential Example 3, taken under an optical microscope.

FIG. 13 is a micrograph of the structure of the alloy flakes for a rare earth sintered magnet prepared in Referential Example 3, taken under a polarization microscope.

FIG. 14 is a micrograph of the structure of the alloy flakes for a rare earth sintered magnet prepared in Referential Comparative Example 1, taken under an optical microscope.

FIG. 15 is a micrograph of the structure of the alloy flakes for a rare earth sintered magnet prepared in Referential Comparative Example 1, taken under a polarization microscope.

PREFERRED EMBODIMENTS OF THE INVENTION

Figure 1:
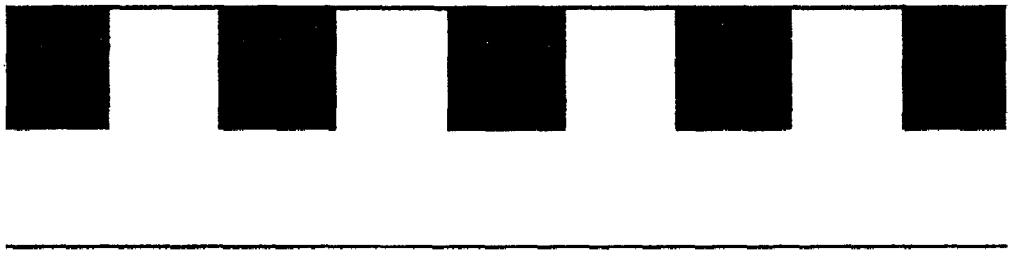
FIG. 1 is a pattern diagram showing an embodiment of the surface layer of a cooling roll used in the present invention in section taken parallel to and including the rotating shaft.

The present invention will now be explained in detail.

In the method for producing alloy flakes for a rare earth sintered magnet according to the present invention, first, step (A) of preparing an alloy melt of a composition consisting of R of at least one element selected from the group consisting of rare earth metal elements including yttrium, boron, and the balance M including iron, is carried out.

The rare earth metal elements are lanthanoids of atomic element numbers 57 to 71 and yttrium of atomic element number 39. R is not particularly limited, and may preferably be, for example, lanthanum, cerium, praseodymium, neodymium, yttrium, gadolinium, terbium, dysprosium, holmium, erbium, ytterbium, or mixtures of two or more of these.

It is particularly preferred that R includes at least one heavy rare earth element selected from the group consisting of gadolinium, terbium, dysprosium, holmium, erbium, and ytterbium. Such heavy rare earth elements improve mainly the coercivity among other magnetic properties, and terbium has the greatest impact in this regard. However, terbium is expensive, so that, in view of the cost and effect, it is preferred to use dysprosium alone or in combination with gadolinium, terbium, holmium, and the like.

A preferred content of R is 27.0 to 33.0 mass %. An R content of less than 27.0 mass % results in shortage of the liquid phase required for densification of the sintered product, so that the density and magnetic properties of the sintered product may be lowered. At over 33.0 mass %, the ratio of the R-rich region in the sintered product is too high, which lowers the corrosion resistance. Also, the ratio of the 2-14-1 phase is relatively lowered, which may lower the magnetic remanence.

The R content in the alloy flakes obtained by the present method may preferably be 29.0 to 33.0 mass % when the alloy flakes are to be used in the single alloy method, and 27.0 to 29.0 mass % when the alloy flakes are to be used as a 2-14-1 phase alloy in the two-alloys method.

When the above-mentioned heavy rare earth elements are used as R, their content is usually 0.2 to 15 mass %, preferably 1 to 15 mass %, more preferably 3 to 15 mass %. At over 15 mass %, the cost is too high, and at less than 0.2 mass %, their effect may not be exhibited.

The content of boron may preferably be 0.94 to 1.30 mass %. At less than 0.94 mass %, the ratio of the 2-14-1 phase is not enough, which lowers the magnetic remanence, whereas at over 1.30 mass %, the B-rich phase content is increased, which lowers both the magnetic properties and the corrosion resistance.

The balance M mentioned above includes iron. The content of iron in the balance M may usually be not less than 50 mass %, preferably not less than 60 mass %. The balance M may optionally contain at least one element selected from the group consisting of silicon, carbon, and other transition metals than iron. The balance M may also contain impurities inevitably introduced in industrial production, such as oxygen, nitrogen, and the like.

The other transition metals than iron are not particularly limited, and may be, for example, at least one element selected from the group consisting of cobalt, aluminum, chromium, titanium, vanadium, zirconium, hafnium, manganese, magnesium, copper, tin, tungsten, niobium, and gallium.

In step (A), the alloy melt may be prepared by melting the starting material by high frequency induction melting in a vacuum or inert gas atmosphere.

In the method of the present invention, step (B) of supplying and solidifying the above alloy melt on a particular cooling roll, is carried out.

The cooling roll used in step (B) has on its roll surface a plurality of linear nucleation inhibiting portions for inhibiting formation of dendrites and chill crystals, and a plurality of nucleating portions for formation of said dendrites, wherein the nucleation inhibiting portions have a region with a width of more than 100 μm.

The nucleation inhibiting portions need to have a region with a width of more than 100 μm. When a particularly large crystal grains are desired, a region with a width of more than 200 μm, or even more than 300 μm, is needed. Without the region with a width of more than 100 μm, the inhibitory effect on formation of chill crystals is not enough, and it is difficult to grow the crystal grains including the R-rich region and the dendrites of the 2-14-1 phase to some extent. There is no particular upper limit for the width of the nucleation inhibiting portions, and a suitable upper limit may be about 3 mm. At wider than about 3 mm, nucleation may occur randomly from the side of the alloy melt opposite to the cooling roll side due to the atmospheric gas, the cooling rate is slow, and segregation is formed, so that the uniformity of the resulting alloy may be impaired. The nucleation inhibiting portions may have a region with a width of not more than 100 μm, as long as the portions have a region with a width of more than 100 μm. The area ratio of the region with a width of more than 100 μm is preferably not less than 80% of the entire nucleation inhibiting portions in contact with the alloy melt.

The term "linear" does not necessarily mean "in the form of a straight line", and may be in the form of a tortuous curved line or the like, i.e., in the form of a line forming a particular pattern. Alternatively, two or more lines of different deflections may form a pattern. The line does not have to be continuous, and may be a broken line formed of lines having a length longer than the width of the inhibiting portions.

On the other hand, the nucleating portions may also be linear like the nucleation inhibiting portions. When the nucleating portions are of a linear configuration, a preferred width thereof may be not more than 30 μm, more preferably not more than 5 μm, for facilitating formation of the dendrites. With a width of over 30 μm, chill crystals may be more likely to form on the nucleating portions.

The nucleating portions are not necessarily of a linear configuration, and may be in the form of dots formed between the intersections of mutually crossing linear nucleation inhibiting portions over the entire surface of the roll. Each dot may preferably have a minimum transverse size of not more than 50 μm, more preferably not more than 30 μm, for facilitating formation of the dendrites.

On the cooling roll, the nucleation inhibiting portions may have a thermal conductivity lower than that of the nucleating portions, so that the nuclei are hard to form in the alloy melt. For example, when the nucleating portions are made of pure copper, the nucleation inhibiting portions may be made of a material that has a thermal conductivity lower than pure copper for the nucleating portions, and has low reactivity with rare earth metal-containing alloys. Preferably, materials having high thermal shock resistance and anti-wear property may be used, such as iron, aluminum, titanium, nickel, or magnesium metal, or an alloy of any of these. The material for the nucleation inhibiting portions is not limited to metals or alloys, and may alternatively be ceramics, such as oxides, carbides, nitrides, or borates, as long as the above conditions are met.

The thermal conductivity of the nucleation inhibiting portions, if made lower than that of the nucleating portions, may preferably be not less than 20 W/mK lower, more preferably be not less than 100 W/mK lower than that of the nucleating portions. For example, when the nucleating portions are made of pure copper, which has a thermal conductivity of 401 W/mK, the nucleation inhibiting portions may preferably be made of a material having a thermal conductivity of not higher than 100 W/mK, such as chromium or nickel. Incidentally, the nucleating portions may preferably be made of copper, iron (80 W/mK), molybdenum (138 W/mK), tungsten (174 W/mK), or nickel (91 W/mK) metal, or an alloy of any of these.

When the nucleation inhibiting portions are made to have a thermal conductivity lower than that of the nucleating portions, these two portions may be formed, for example, by forming the nucleation inhibiting portions on the roll of a material for the nucleating portions in the following manner.

For example, portions of a cooling roll surface corresponding to the nucleating portions are masked by a conventional method, and linear nucleation inhibiting portions are formed by sputtering, thermal spraying, plating, or the like. Alternatively, the nucleation inhibiting portions are formed all over the cooling roll by the above or other method, and then portions of a cooling roll surface corresponding to the nucleating portions are exposed by machining, such as cutting, or by laser machining, or portions of a cooling roll surface corresponding to the nucleation inhibiting portions are masked, and then the nucleating portions are exposed by chemical etching.

For forming the nucleating portions and the nucleation inhibiting portions flat with each other, a roll of a material for the nucleating portions is processed by machining, such as cutting, or by laser machining to form concaves thereon corresponding to the linear nucleation inhibiting portions, and the concaves are filled with a material having a lower thermal conductivity by the methods mentioned above to make the surface flat.

The nucleation inhibiting portions do not necessarily have a thermal conductivity lower than that of the nucleating portions. The nucleating portions may be made in the form of convex portions composed of projections of linear or dot shape, whereas the nucleation inhibiting portions may be made in the form of linear concave portions formed between the convex nucleating portions.

The nucleation inhibiting portions may be made in the form of linear concaves by machining, such as cutting, or laser machining the cooling roll surface to leave the convex portions, such as projections, or by masking the portions of the cooling roll surface corresponding to the convex portions and chemical etching.

The depth of the concaves is not particularly limited when the concaves and the convexes are formed of the above materials of quite different thermal conductivities. On the other hand, when the concaves and the convexes are formed of the same material or of materials of slightly different thermal conductivities, the depth of the concaves may be preferably deeper than 50 μm, more preferably deeper than 100 μm, most preferably deeper than 200 μm, as measured from the top of the convexes, so that the alloy melt is brought into contact with the convexes and kept out of contact with at least the bottom of the concaves in step (B). With a depth of not deeper than 50 μm, the alloy melt may contact the bottom of the concaves, where the nuclei may be formed to cause formation of chill crystals, and the desired alloy structure may not be obtained.

Reference is made to the drawings to explain examples of how to form the nucleating portions and the nucleation inhibiting portions.

FIG. 1 illustrates a pattern of a sectional surface of a roll taken parallel to and including the rotating shaft, wherein the white portions represent the nucleating portions and the black portions represent the linear nucleation inhibiting portions. This figure is merely a pattern diagram, and the nucleation inhibiting portions are required to have a region with a width of more than 100 μm.

When the nucleating portions are of a linear configuration as shown in FIG. 1, a preferred width thereof may be not more than 30 μm for facilitating formation of the dendrites.

Figure 4:
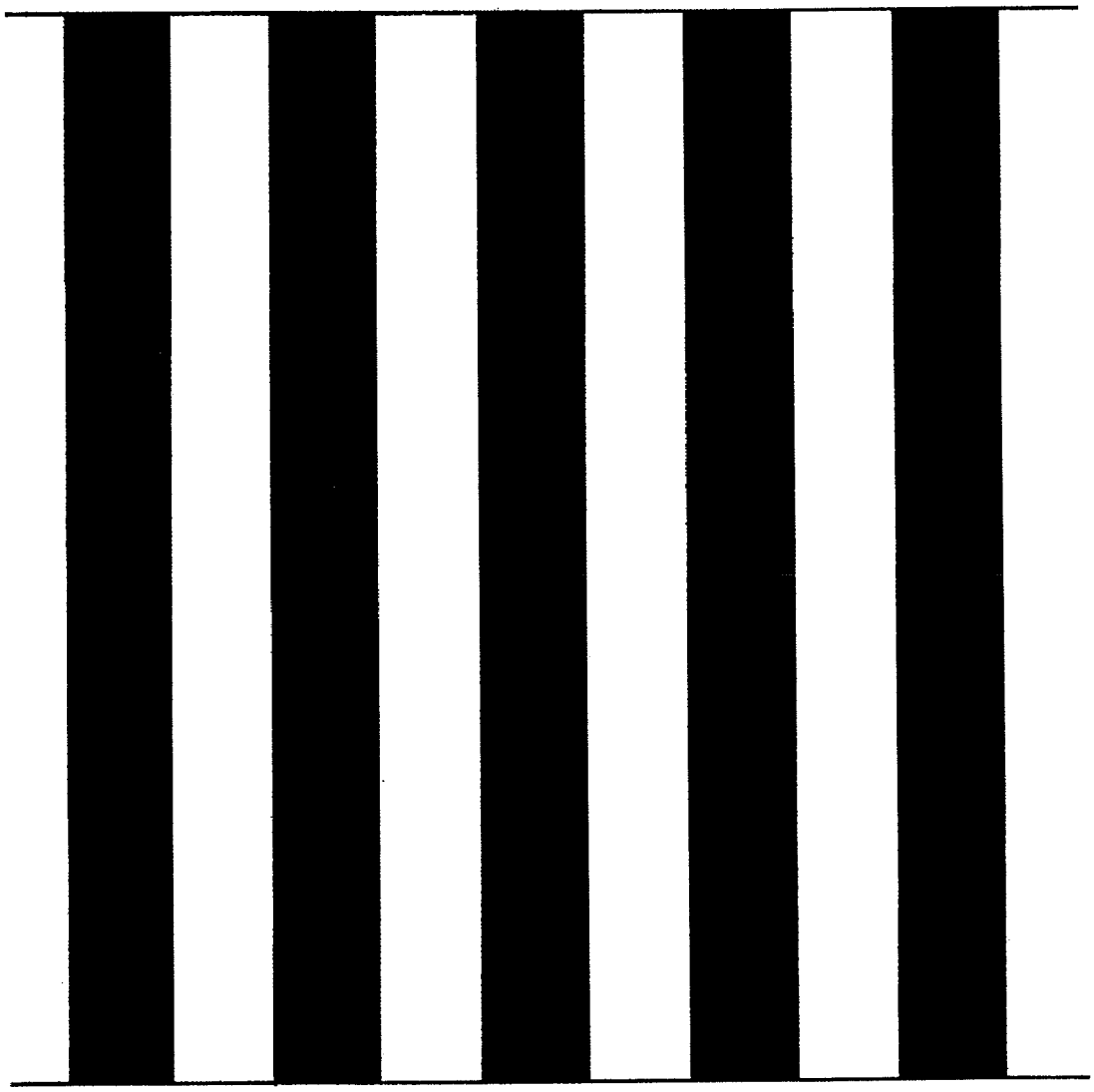
FIG. 4 is a pattern diagram showing an embodiment of the surface pattern of the nucleating portions and the nucleation inhibiting portions of a cooling roll used in the present invention.

When both the nucleating portions and the nucleation inhibiting portions are of linear configurations, each portion may be formed in the direction of rotation of the roll to extend to make a full circle. A pattern diagram showing such nucleating portions and nucleation inhibiting portions is shown in FIG. 4.

Figure 5:
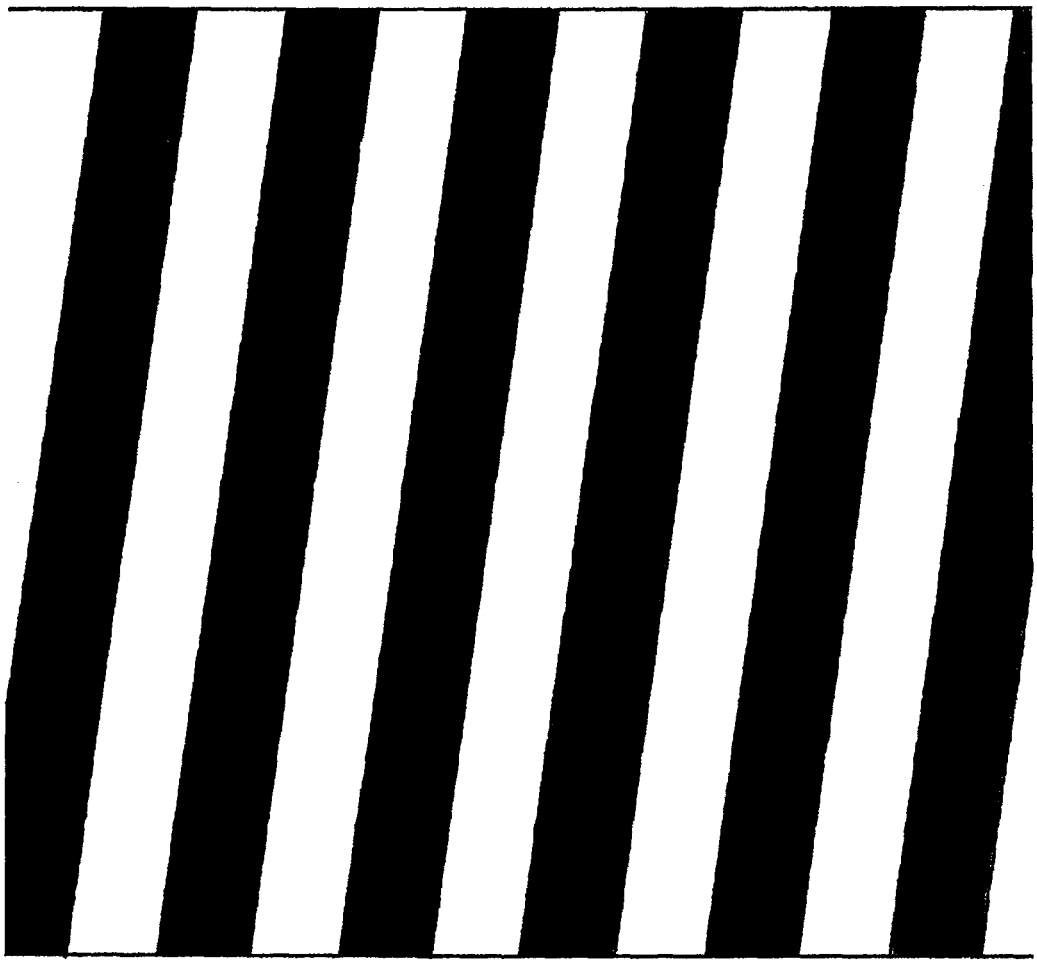
FIG. 5 is a pattern diagram showing another embodiment of the surface pattern of the nucleating portions and the nucleation inhibiting portions of a cooling roll used in the present invention.

Alternatively, each of the nucleating portions and the nucleation inhibiting portions may be formed in the direction of rotation of the roll to extend spirally without making a full circle. A pattern diagram showing such nucleating portions and nucleation inhibiting portions is shown in FIG. 5.

Figure 6:
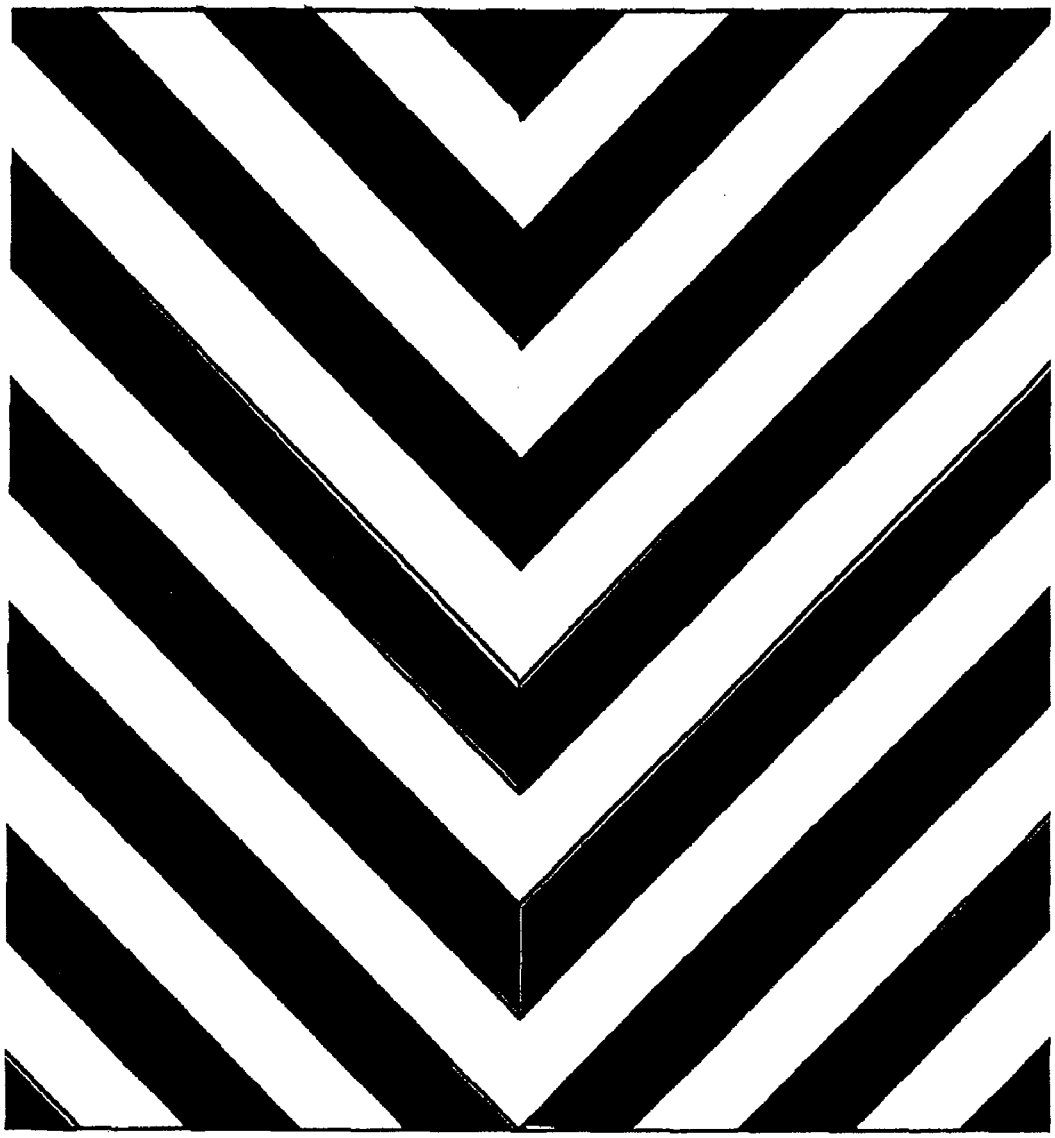
FIG. 6 is a pattern diagram showing yet another embodiment of the surface pattern of the nucleating portions and the nucleation inhibiting portions of a cooling roll used in the present invention.

The linear nucleation inhibiting portions and the linear nucleating portions may be formed in two or more patterns of different orientations. A pattern diagram showing such nucleating portions and nucleation inhibiting portions is shown in FIG. 6.

Figure 2:
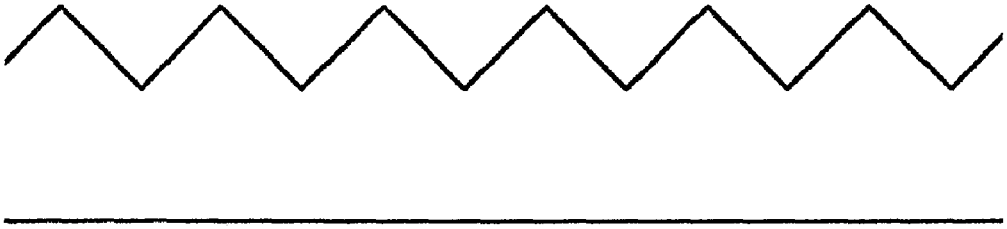
FIG. 2 is a pattern diagram showing another embodiment of the surface layer of a cooling roll used in the present invention in section taken parallel to and including the rotating shaft.
Figure 3:
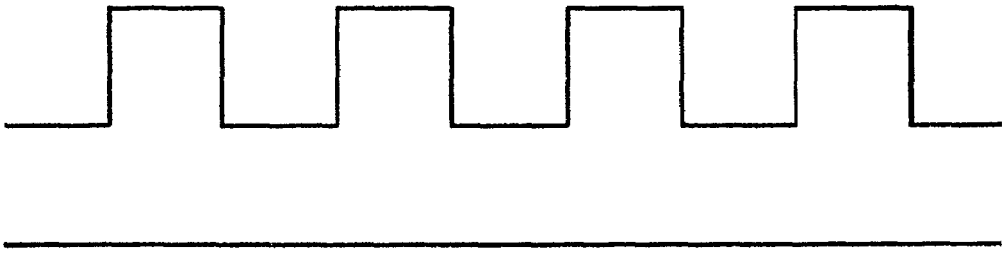
FIG. 3 is a pattern diagram showing yet another embodiment of the surface layer of a cooling roll used in the present invention in section taken parallel to and including the rotating shaft.

Examples of the nucleating portions and the nucleation inhibiting portions in the form of continuous lines have been discussed above, but the lines are not necessarily continuous. For example, each line may be made of lines of a length longer than the width of the portions to form a broken line. Further, when the materials of different thermal conductivities are used as mentioned above, each pattern may be made with a flat surface, or alternatively, made to have convexes and concaves as shown in FIGS. 2 and 3, which are pattern diagrams of embodiments of a roll having convexes and concaves in section taken parallel to and including the rotating shaft.

Figure 7:
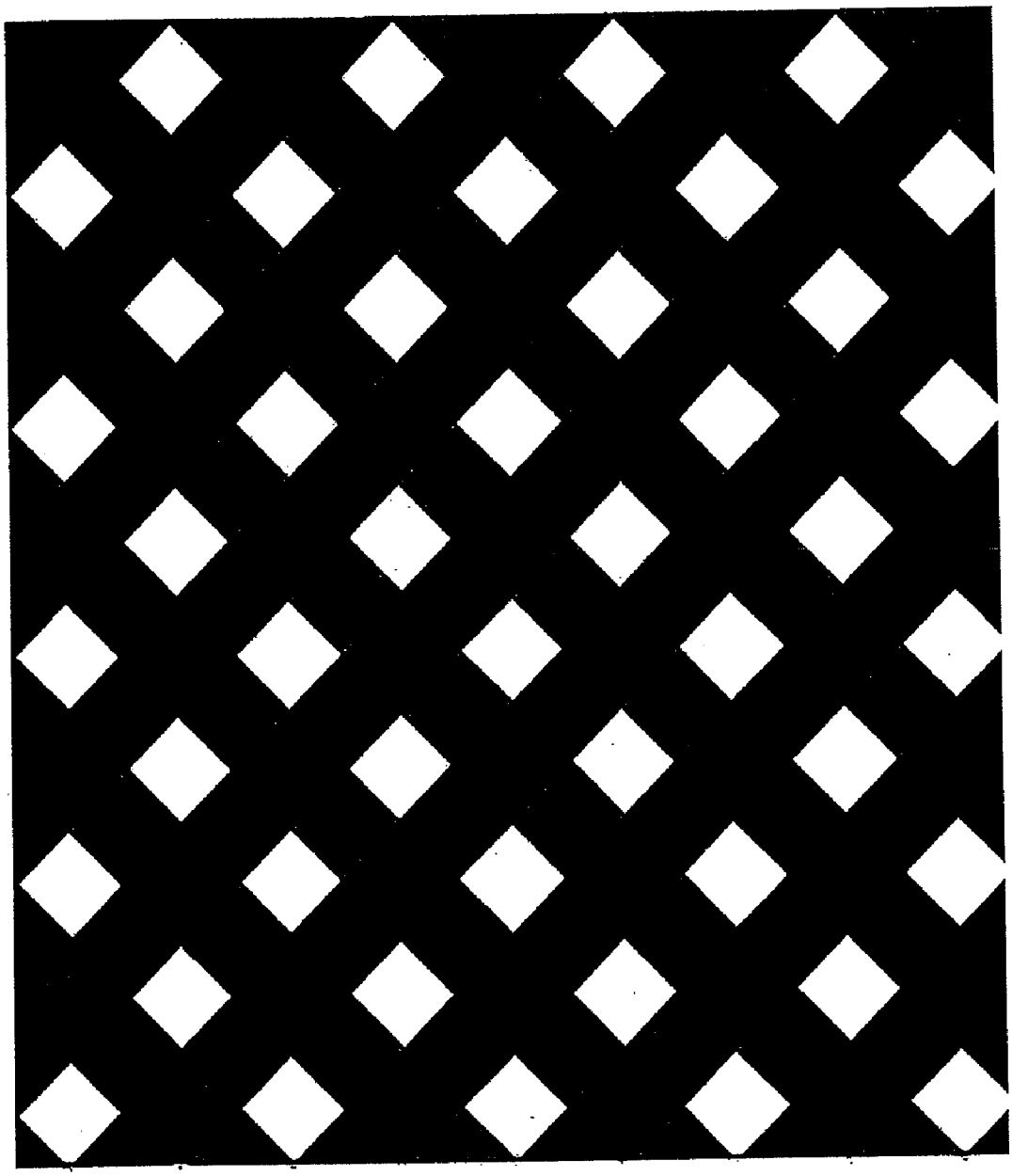
FIG. 7 is a pattern diagram showing still another embodiment of the surface pattern of the nucleating portions and the nucleation inhibiting portions of a cooling roll used in the present invention.

The nucleating portions are not necessarily of a linear configuration, and may be in the form of dots formed between the intersections of mutually crossing linear nucleation inhibiting portions over the entire surface of the roll. A diagram of such a pattern is shown in FIG. 7, wherein the white portions represent the nucleating portions.

In FIGS. 4 to 7, the roll is shown to rotate in the direction from the bottom to the top of each figure.

The nucleating portions and the nucleation inhibiting portions may be coated with a material having a high anti-wear property or a material having a low reactivity to the alloy melt, by plating the entire surface of the roll as long as the difference in thermal conductivity is not impaired.

The nucleation inhibiting portions and the nucleating portions are preferably arranged in substantially a uniform pattern over the cooling roll surface as shown in the figures for achieving more uniform intervals, size, orientation, shape, and the like of the R-rich region and the dendrites of the 2-14-1 phase to obtain the desired alloy structure, but preferred examples are not limited to those shown in the drawings.

An example of a cooling roll most conveniently used in step (B) may be a cooling roll for producing rare earth alloy flakes wherein a plurality of linear convexes and linear concaves between the convexes are formed on the cooling roll surface in the direction of rotation, the concaves have a width of more than 100 μm and a depth deeper than 50 μm from the top of the convexes, and the convexes have a top width of not more than 30 μm. Here, the linear convexes and concaves may extend spirally in the direction of rotation of the roll. The convexes, i.e., the nucleating portions, do not have to be in the form of continuous lines, and may be in the form of broken lines.

In step (B), wherein the alloy melt prepared in step (A) is supplied and solidified on the cooling roll, the conditions for this step may suitably be selected and decided with reference to the conditions for ordinary production of alloy flakes for rare earth sintered magnets using a cooling roll so that the alloy structure is obtained which contains an R-rich region and dendrites of a 2-14-1 phase with a dendrite content of not lower than 80 vol %.

For example, when a cooling roll is used wherein the nucleation inhibiting portions and the nucleating portions are made of materials of different thermal conductivities, irrespective of whether the nucleation inhibiting portions and the nucleating portions are made in the form of concaves and convexes or made flat with each other, the amount and rate of the alloy melt to be supplied to the cooling roll, and the rotational speed of the cooling roll may suitably be selected and decided so that the alloy melt is brought into contact with the nucleation inhibiting portions and the nucleating portions.

On the other hand, when the nucleation inhibiting portions and the nucleating portions are made of materials without such difference in thermal conductivity, the amount and rate of the alloy melt to be supplied to the cooling roll, and the rotational speed of the cooling roll may suitably be selected and decided so that the alloy melt is brought into contact with the convexes of the cooling roll but not with at least the bottom of the concaves. Here, in order to keep the alloy melt out of contact with at least the bottom of the concaves, an inert gas may be circulated through the concaves.

The solidification in step (B) is preferably carried out, using an inert gas, such as argon or helium, as the atmospheric gas in contacting the alloy melt to the cooling roll, and under a regulated gas pressure, under the conditions for obtaining alloy flakes of usually 0.05 to 2 mm thick, preferably 0.2 to 0.8 mm thick.

Step (B) may be carried out by single-roll or double-roll strip casting.

The cooling rate in step (B) may be controlled in accordance with a conventional method, such as controlling the temperature of the alloy melt, the amount of the alloy melt to be supplied, and the surface velocity of the roll.

The cooling rate for the period from the supply of the alloy melt to the roll until the alloy flakes are separated from the roll, may be controlled to usually $3\times10^{2}$ to $1\times10^{5}$° C./sec, preferably $4\times10^{2}$ to $1\times10^{3}$° C./sec. At a cooling rate of higher than $1\times10^{5}$° C./sec, the average interval between the R-rich regions becomes smaller than 1 μm and a substantial amount of chill crystals may disadvantageously precipitate. At a cooling rate of lower than $3\times10^{2}$° C./sec, the average interval between the R-rich regions becomes larger than 20 μm, or a substantial amount of an α-Fe phase, or even a coarse α-Fe phase, may disadvantageously precipitate.

In step (B), the alloy melt may be supplied to the cooling roll via a tundish. The tundish is preferably arranged at a position above the rotational shaft, below the top of the single roll, and behind the rotational shaft in the direction of rotation, so that the alloy melt forms a sufficient alloy melt pool between the single roll and the tundish. It is preferred that the tundish is not of a nozzle type, but of a structure having an open top for the alloy melt.

The temperature of the alloy melt may preferably be not less than 20° C. higher, more preferably not less than 100° C. higher than the melting point. The alloy melt may preferably be poured at a constant rate in a constant amount with least pulsation. For example, it is preferred to use a pouring system disclosed in JP-9-212243-A.

According to the method of the present invention, after step (B) and before the flakes are cooled to the room temperature, a heat treatment may be performed by heating the flakes or holding the flakes at a constant temperature. However, if the heat treatment is effected at too high a temperature or for too long a period, the average interval between the R-rich regions becomes too large, or the R-rich region may segregate, to lower the magnetic properties. Alternatively, the heat treatment may be effected by heating the alloy flakes after the flakes are cooled to a near room temperature.

The alloy flakes for a rare earth sintered magnet according to the present invention are alloy flakes obtained by the method of the present invention and having an alloy structure containing an R-rich region and dendrites of a 2-14-1 phase, and further having a particular chill crystal content and a particular average size of the crystal grains including the R-rich region and the dendrites of a 2-14-1 phase.

The alloy structure containing the R-rich region and the dendrites of the 2-14-1 phase is readily observable under an optical microscope. As examples, optical micrographs of the structures of the alloy flakes for a rare earth sintered magnet prepared in Example 2 and Comparative Example 1 to be discussed later are shown in FIGS. 8 and 10, respectively. In FIGS. 8 and 10, the black portions in the form of lines or islands represent the R-rich region, whereas the white portions are dendrites of the 2-14-1 phase. As can be seen in the figures, the R-rich region is arranged surrounding the dendrites of the 2-14-1 phase.

In the alloy flakes of the present invention, the particular alloy structure contains not lower than 80 vol %, preferably not lower than 85 vol % dendrites of the 2-14-1 phase. At less than 80 vol %, the magnetic remanence of the resulting sintered magnet may be lowered.

The volume ratio of the 2-14-1 phase is taken as an area ratio of the 2-14-1 phase determined by image analysis of a Compo image of EPMA of a cross section of an alloy flake taken in the direction of its thickness at right angles to the transfer of the alloy flakes separated from the cooling roll (C-section with respect to the direction of rotation of the roll). The area ratio of over ten alloy flakes were determined in this way, and the average thereof was used as the volume ratio of the dendrites of the 2-14-1 phase. Incidentally, the 2-14-1 phase present in chill crystals to be discussed below, was not included in determining the volume ratio of the 2-14-1 phase.

In the structure of the alloy flakes of the present invention, the chill crystal content is not higher than 1 vol %, preferably not higher than 0.5 vol %. However, the chill crystal content of alloy flakes obtained by the method of the present invention discussed above is not limited to the content in the alloy flakes of the present invention, and may be not higher than 5 vol %, preferably not higher than 2 vol %, most preferably the same content as in the alloy flakes of the present invention.

At the chill crystal content of not higher than 5 vol %, in particular not higher than 1 vol %, the magnet to be produced is given an improved magnetic remanence. Further, when the alloy flakes are finely pulverized in a jet mill or the like into powder of a 3 to 7 μm size in the production process of magnets, the resulting powder contains a reduced amount of extremely fine powder of about 1 to 3 μm in size, so that abnormal grain growth in the following sintering step may be inhibited and the coercivity may be improved. Such effects are stronger when the chill crystal content is lower.

The chill crystals are fine equiaxed grains of not larger than 1 μm, and formed with instantaneous formation of a large number of nuclei near the cooling roll surface.

The chill crystal content may be determined by taking and polishing a cross section of an alloy flake for a rare earth sintered magnet in the direction of its thickness at right angles to the transfer of the alloy flakes separated from the cooling roll (C-section with respect to the direction of rotation of the roll), taking a micrograph of the structure under a polarization microscope at ×200, and determining the area of the chill crystals with respect to the area of the entire cross section in the micrograph. Over ten alloy flakes were subjected to the measurements, and the average of the obtained values was used as the volume ratio of the chill crystals. Under a polarization microscope, the chill crystals are clearly observed to be fine, randomly-oriented crystals, so that the area of the chill crystals may easily be identified.

In the alloy flakes for a rare earth sintered magnet according to the present invention, the average interval between the R-rich regions may preferably be 1 to 20 μm, more preferably 3 to 8 μm. With such a small average intervals between the R-rich regions, for example, when the alloy flakes are finely pulverized into powder of a 3 to 7 μm size in the production process of a sintered magnet, the resulting alloy powder contains a high ratio of powder particles having the R-rich region in a single powder particle. When a sintered magnet is produced from such powder particles, the R-rich region is uniformly dispersed to be a liquid phase upon sintering, and effectively spread among the grains of the 2-14-1 phase, so that the density and the magnetic remanence of the resulting sintered magnet are improved. Further, since the surface of the grains of the 2-14-1 phase is coated with the R-rich region, the grains are segmented not to contact with each other, so that abnormal grain growth upon sintering is inhibited and the coercivity is improved.

If the average interval between the R-rich regions is more than 20 μm, for example, when the alloy flakes are finely pulverized into powder with an average particle size of about 3 to 7 μm, the ratio of powder particles having the R-rich region in a single powder particle in the resulting alloy powder may be lowered. When a sintered magnet is produced from such powder particles, the R-rich region becomes a liquid phase in a segregated state upon sintering, and is not spread sufficiently among the grains of the 2-14-1 phase, so that the density is hard to be increased and the magnetic remanence is low. Further, if the sintering step is effected at a higher temperature or for a prolonged period of time in order to increase the density, the grains of the 2-14-1 phase undergo abnormal grain growth, which may result in insufficient coercivity. On the other hand, if the average interval between the R-rich regions is less than 1 μm, the pulverization gives rise to extremely fine powder particles, which are prone to oxidation and lower the magnetic remanence.

The average interval between the R-rich regions may be determined by the following method.

First, a cross section of an alloy flake for a rare earth sintered magnet is taken in the direction of its thickness at right angles to the transfer of the alloy flakes separated from the cooling roll (C-section with respect to the direction of rotation of the roll), polishing and etching the cross section with nitric acid, and taking a micrograph of the structure under an optical microscope at ×200. As mentioned above, the R-rich region is surrounding the dendrites of the 2-14-1 phase. The R-rich region is usually present in the form of lines, but may sometimes be in the form of islands depending on the thermal history during the casting process. In the cross section of the alloy flake, a line corresponding to 400 μm passing through the center of the cross section in the direction of its thickness is drawn in the direction of width of the cross section, and the number of the R-rich region crossing the line is counted, and the length of the line (400 μm) extending in the direction of width of the cross section is divided with the number of the R-rich regions counted. Over 20 alloy flakes were subjected to the same measurement, and the average of the obtained values may be used as the average interval between the R-rich regions. Even when the R-rich region is present in the form of islands, if the islands are continuously arranged to apparently form a line, such islands of the R-rich region are connected and measured in the same way as for the R-rich region in the form of a line.

In the alloy flakes for a rare earth sintered magnet according to the present invention, the average size of the crystal grains including the R-rich region and the dendrites of the 2-14-1 phase observable under a polarization microscope is not smaller than 40 μm, and may preferably be, in relation to the average interval r between the R-rich regions discussed above, larger than $(6r+2.74x-65)$ μm, wherein r stands for an average interval between the R-rich regions, and x stands for a content of R mentioned above in mass %. Controlling both the average crystal grain size and the average interval r between the R-rich regions is preferred for obtaining a sintered magnet wherein the orientation is improved to the maximum without impairing the sinterability and the coercivity. However, with the average crystal grain size of 300 μm or larger, the conditions for the average interval r may not be satisfied, and coarse α-Fe may be formed, which adversely affects the pulverizability.

Incidentally, the alloy flakes of the present invention are required to have the above average crystal grain size, but alloy flakes obtained by the method of the present invention discussed above do not necessarily have the average crystal grain size of not smaller than 40 μm.

The crystal grains observable under a polarization microscope are, for example, the portions seen in the same tone in FIGS. 9 and 11, which are the micrographs of the structures of the alloy flakes for a rare earth sintered magnet prepared in Example 2 and Comparative Example 1, respectively, to be discussed later, taken under a polarization microscope. The adjacent dendrites having generally the same, aligned crystal orientation are observed as the crystal grains mentioned above.

The average crystal grain size may be determined in the following way.

A cross section of an alloy flake for a rare earth sintered magnet is taken in the direction of its thickness at right angles to the transfer of the alloy flakes separated from the cooling roll (C-section with respect to the direction of the rotation of the roll), polishing the cross section, and taking a micrograph of the structure under a polarization microscope at ×200. A line corresponding to 1000 μm passing through the center of the cross section in the direction of its thickness is drawn in the direction of width of the cross section, the number of the grain boundaries crossing the line is counted, and the length of the line (1000 μm) extending in the direction of width of the cross section is divided with the number of the grain boundaries counted. Over 10 alloy flakes were subjected to the same measurement, and the average of the obtained values is used as the average crystal grain size.

A preferred thickness of the alloy flakes of the present invention is usually 0.05 to 2 mm, particularly 0.2 to 0.8 mm.

With the thickness outside the range of 0.05 to 2 mm, the ratio of the dendrites of the 2-14-1 phase does not fall within the desired range, or the cooling rate in the production process is slow, so that the desired alloy structure may not be obtained.

The alloy flakes for a rare earth sintered magnet according to the present invention preferably contains no α-Fe phase, which, though, may be contained as long as it does not seriously affect the pulverizability of the alloy flakes. Usually, an α-Fe phase appears in alloy flakes at a position where the cooling rate is slow. For example, when alloy flakes are produced by single-roll strip casting, the α-Fe phase appears on the free surface (the surface opposite to the cooling surface). It is preferred that the α-Fe phase, if contained, is precipitated in the grain size of not larger than 3 μm, and the content thereof is not more than 5 vol %.

The rare earth sintered magnet according to the present invention may be produced by pulverizing, compacting, sintering, and ageing a raw material alloy flakes containing the alloy flakes for a rare earth sintered magnet of the present invention. The above steps may be carried out in accordance with conventional methods.

The pulverization may be carried out, for example, by coarsely pulverizing the alloy flakes by hydrogenation and dehydrogenation, and finely pulverizing the resulting particles in a jet mill or the like into powder with an average particle size of 3 to 7 μm. When the alloy flakes are to be used in a two-alloys method, it is preferred to mix, prior to the pulverization, the present alloy flakes for a rare earth sintered magnet as the main phase alloy with a boundary-phase alloy. The boundary-phase alloy may be an alloy obtained by a conventional method, such as strip casting or molding.

The finely pulverized powder particles give higher orientation and magnetic remanence to the resulting sintered magnet, when each single particle has less crystal grains of different crystal orientations. For lowering the ratio of the powder particles having the crystal grains of different crystal orientations in a single particle, the ratio of the crystal grain boundaries in the alloy flakes must be lowered.

The compacting may be carried out, for example, by optionally mixing the pulverized particles with a binder, such as a stearate, and pressure-forming the particles in a magnetic field.

The sintering may be carried out, for example, by heating the compacted body at 900 to 1150° C. for 0.5 to 5 hours in vacuum or an inert gas atmosphere.

The ageing may be carried out, for example, by heating sintered product at 500 to 900° C. for 0.5 to 5 hours in vacuum or an inert gas atmosphere.

The inventors of the present invention have found out that, unlike the present alloy flakes for a rare earth sintered magnet, even alloy flakes which contain larger crystal grains and of which crystal grains in the alloy structure observable under a polarization microscope do not have a uniform size but random, could provide excellent magnetic properties.

The inventors of the present invention have made researches for means for keeping short the intervals between the R-rich regions in the alloy flakes for an $R_2Fe_{14}B$ type rare earth sintered magnet, while making larger the crystal grains in the alloy structure observable under a polarization microscope. In order to minimize the intervals between the R-rich regions, it is the required and sufficient conditions to increase the primary cooling rate. Thus the inventors have searched for means for increasing the crystal grain size, while the primary cooling rate is kept at a high level.

In general, dendrites of an alloy grow in the direction of the heat current. For example, in single-roll strip casting, dendrites grow from the roll surface substantially vertically toward the free surface. Irrespective of this, the inventors of the present invention have confirmed through experiments that, when the number of nuclei formed in an alloy melt is reduced compared to the ordinary strip casting, dendrites grow at certain angles as well as substantially vertically to form larger crystal grains than those grew in the ordinary strip casting. By such reduction in number of nuclei, the conventional correlation between the intervals between the R-rich regions and the crystal grain size is dissolved, to obtain alloy flakes having a structure wherein the intervals between the R-rich regions is short and the crystal grain size is large. The inventors have further found out that a magnet produced from such novel alloy flakes for a rare earth sintered magnet having a short average intervals between the R-rich regions and a large crystal grain size exhibits improved magnetic remanence and coercivity.

Such alloy flakes for a rare earth sintered magnet (referred to as referential alloy flakes hereinbelow) are characterized by the composition consisting of 27.0 to 33.0 mass % R of at least one element selected from the group consisting of rare earth metal elements including yttrium, 0.94 to 1.30 mass % boron, and the balance M including iron, and the alloy structure containing an R-rich region and dendrites of a 2-14-1 phase, wherein the average interval r between the R-rich regions is 1 to 10 μm, and the average size of the crystal grains including the R-rich region and the dendrites of the 2-14-1 phase in the alloy structure is larger than (6r+2.74x−65) μm (wherein r stands for the average interval between the R-rich regions, and x stands for the content of R in mass %) and not smaller than 40 μm.

The referential alloy flakes will now be discussed in detail below.

The referential alloy flakes have a composition similar to that of the alloy flakes of the present invention, and examples of the composition are as discussed above.

The referential alloy flakes have an alloy structure containing an R-rich region and dendrites of a 2-14-1 phase.

Micrographs of the structures of the alloy flakes for a rare earth sintered magnet prepared in Referential Example 3 and Referential Comparative Example 1 to be discussed later taken under an optical microscope are shown in FIGS. 12 and 14, respectively, and those taken under a polarization microscope are shown in FIGS. 13 and 15, respectively. In FIGS. 12 and 14, the R-rich region is observed as black lines or islands. In FIGS. 13 and 15, the dendrites of the 2-14-1 phase are seen in white. As seen from the figures, the R-rich region is arranged surrounding the dendrites of the 2-14-1 phase. In FIGS. 13 and 15, the crystal grains are seen in the same tone. The adjacent dendrites having generally the same, aligned crystal orientation are observed as the crystal grains mentioned above. Incidentally, the minimum scale value in each figure is 10 μm.

The average interval r between the R-rich regions is 1 to 10 μm, preferably 3 to 6 μm. With such a short average interval between the R-rich regions, for example, when the alloy flakes are finely pulverized into powder with an average particle size of about 3 to 7 μm in the production process of a sintered magnet, the resulting alloy powder contains a high ratio of powder particles having the R-rich region in a single powder particle. When a sintered magnet is produced from such powder particles, the R-rich region is uniformly dispersed to be a liquid phase upon sintering, and effectively spread among the grains of the 2-14-1 phase, so that the density and the magnetic remanence of the resulting sintered magnet are improved. Further, since the surface of the grains of the 2-14-1 phase is coated with the R-rich region, the grains are segmented not to contact with each other, so that abnormal grain growth upon sintering is inhibited and the coercivity is improved. If the average interval between the R-rich regions is more than 10 μm, for example, when the alloy flakes are finely pulverized into powder with an average particle size of about 3 to 7 μm, the ratio of powder particles having the R-rich region in a single powder particle in the resulting alloy powder may be lowered. When a sintered magnet is produced from such powder particles, the R-rich region becomes a liquid phase in a segregated state upon sintering, and is not spread sufficiently among the grains of the 2-14-1 phase, so that the density is hard to be increased and the magnetic remanence is low. Further, if the sintering step is effected at a higher temperature or for a prolonged period of time in order to increase the density, the grains of the 2-14-1 phase undergo abnormal grain growth, which results in insufficient coercivity. On the other hand, if the average intervals between the R-rich regions is less than 1 μm, the pulverization gives rise to extremely fine powders, which are prone to oxidation and lower the magnetic remanence.

The average interval r between the R-rich regions may be determined by the method discussed above.

The referential alloy flakes are usually finely pulverized into powder with a particle size of about 3 to 7 μm before produced into a sintered magnet. The finely pulverized powder particles give higher orientation and magnetic remanence to the resulting sintered magnet, when each single particle has less crystal grains of different crystal orientations. For lowering the ratio of the powder particles having the crystal grains of different crystal orientations in a single particle, the ratio of the crystal grain boundaries in the alloy flakes must be lowered.

Accordingly, the alloy structure preferably contains larger crystal grains, and a preferred average size of the crystal grains is usually not smaller than 50 μm, more preferably not smaller than 70 μm, most preferably not smaller than 90 μm. With the average crystal grain size of 300 μm or larger, the conditions for the average interval r may not be satisfied, and coarse α-Fe may be formed, which adversely affects the pulverizability.

In the referential alloy flakes, the average size of the crystal grains in the alloy structure in relation to the average interval r between the R-rich regions is required to be larger than (6r+2.74x−65) μm, and not smaller than 40 μm. By controlling both the average crystal grain size and the average interval r between the R-rich regions, a sintered magnet may be obtained wherein the orientation is improved to the maximum without impairing the sinterability and coercivity. With the average crystal grain size of not larger than (6r+2.74x−65) μm or less than 40 μm, the above desired effect cannot be obtained.

The average crystal grain size in the structure of the referential alloy flakes may be determined in the same way as discussed above.

In the referential alloy flakes, a preferred content of the 2-14-1 phase is usually not less than 80 vol %, more preferably not less than 85 vol %, most preferably not less than 90 vol %. At less than 80 vol %, the volume ratio of the R-rich region is relatively too high, and the magnetic remanence of the resulting sintered magnet may be lowered.

The volume ratio of the 2-14-1 phase may be determined in the same way as discussed above.

The referential alloy flakes preferably contains no α-Fe phase, which, though, may be contained as long as it does not seriously affect the pulverizability of the alloy flakes. Usually, an α-Fe phase appears in alloy flakes at a position where the cooling rate is slow. For example, when alloy flakes are produced by single-roll strip casting, the α-Fe phase appears on the free surface (the surface opposite to the cooling surface). It is preferred that the α-Fe phase, if contained, is precipitated in the grain size of not larger than 3 μm, and the content thereof is not more than 5 vol %.

A preferred thickness of the referential alloy flakes is usually 0.1 to 1.0 mm, particularly 0.2 to 0.5 mm. With the thickness outside the range of 0.1 to 1.0 mm, it is difficult to produce the referential alloy flakes, thus not being preferred.

The referential alloy flakes may be prepared by solidifying on a cooling roll an alloy melt having a composition of R, boron, and the balance M adjusted to be within the above compositional range, by strip casting via a tundish, wherein the number of nuclei formed in the alloy melt and the cooling rate are controlled.

The alloy melt may be prepared by melting the starting material by high frequency induction melting in a vacuum or inert gas atmosphere. The roll may be a single roll or double rolls.

The cooling rate may be controlled by a conventional method, such as controlling the temperature of the alloy melt, the amount of the alloy melt supplied, and the thermal conductivity, cooling performance, and surface velocity of the roll.

The cooling rate for the period from the supply of the alloy melt to the roll until the alloy flakes are separated from the roll may be controlled to usually $3\times10^2$ to $1\times10^{5}$° C./sec, preferably $4\times10^2$ to $1\times10^{3}$° C./sec. At a cooling rate of higher than $1\times10^{5}$° C./sec, the average interval between the R-rich regions becomes smaller than 1 μm and a substantial amount of chill crystals may disadvantageously precipitate. At a cooling rate of lower than $3\times10^{2}$° C./sec, the average interval between the R-rich regions becomes larger than 10 μm, or a substantial amount of an α-Fe phase, or even a coarse α-Fe phase, may disadvantageously precipitate.

The number of nuclei may be controlled by eliminating, as much as possible, the factors for formation of the nuclei in the alloy melt in ordinary strip casting, and setting the conditions for reducing the number of nuclei. Specifically, the number of nuclei may suitably be controlled by controlling the arrangement, shape, and material of the tundish; the material, surface properties, and surface configuration of the roll; the temperature and manner of pouring of the alloy melt; and removal of rare earth oxides generated in melting the alloys.

The tundish is preferably arranged at a position above the rotational shaft, below the top of the single roll, and behind the rotational shaft in the direction of rotation, so that the alloy melt forms a sufficient alloy melt pool between the single roll and the tundish. Formation of such an alloy melt pool stabilizes the number of nuclei formed. It is preferred that the tundish is not of a nozzle type, but of a structure having an open top for the alloy melt. A weir may be arranged in the tundish for controlling the flow rate of or rectifying the alloy melt, but an excess number of weirs may disadvantageously increase the number of nuclei.

The tundish may be, for example, one disclosed in JP-9-155513-A. For reducing the number of nuclei formed on the tundish, the tundish is preferably preheated externally by a heater, or internally by a built-in heater. It is preferred to preheat the tundish to 500° C. or higher.

The tundish may be made of ceramics, such as alumina, silica, zirconia, magnesia, yttria, mulite, silicon carbide, silicon nitride, aluminum nitride, titanium boride, sialon, or aluminum titanate, or refractory materials containing graphite or the like. Further, it is also preferred to coat the tundish with a highly heat-resistant material, such as tungsten, rhenium, titanium carbide, tantalum carbide, hafnium carbide, or tungsten carbide.

The roll may preferably be made of a material having a thermal conductivity lower than that of pure copper or copper alloys, which are conventionally used for a roll for strip casting. Examples of the material may include iron, aluminum, titanium, nickel, or magnesium metal, or alloys of any of these. A roll made of a copper alloy may be provided, on its surface, with a coating layer of a material with a low thermal conductivity, such as the above mentioned metals or alloys, or with a ceramics layer, such as the metals, oxides, nitrides, or carbides referred to above as examples of the material of or the coating material for the tundish. The coating layer may be formed by plating, thermal spraying, or the like means. By arranging the coating layer in dotted, linear, or the like pattern, the coating layer or the uncoated roll surface may function as a starting point of the nucleation. If only a copper alloy or the like is used for the roll as in the conventional roll, a large amount of nuclei are formed on the contacting surface between the alloy melt and the roll surface, making it difficult to control the average crystal grain size to larger than (6r+2.74x−65) μm and not smaller than 40 μm.

The roughness of the roll surface is preferably less than 3 μm, more preferably less than 2 μm in arithmetical mean roughness (Ra). The arithmetical mean roughness (Ra) may be measured with SURFTEST SV-400 manufactured by MITSUTOYO CORPORATION at a length of each measurement section of 8 mm, for a total of three sections.

Under the above conditions, the roll has only a little convexes which function as the starting point of nucleation, so that the number of nuclei may be reduced.

In contrast, convexes acting as the starting point of nucleation may be formed on the roll surface generally at regular intervals.

Such convexes may be formed on the roll surface by machining, such as lathing, or laser dimpling. With such convexes, atmospheric gas is retained in the concaves, and nucleation occurs at the convexes to form a constant number of nuclei generally at regular intervals. Further, by adjusting the water-cooling mechanism inside the roll, cooling points may be distributed over the roll surface, which points may be used as the starting point of nucleation.

The temperature of the alloy melt may be not less than 20° C. higher, more preferably not less than 100° C. higher than the melting point, for reducing the number of nuclei formed in the alloy melt.

The alloy melt may preferably be poured at a constant rate in a constant amount with least pulsation.

Removal of rare earth oxides generated in melting the alloy is also effective for controlling nucleation. Since rare earth metals are highly reactive, they react with the oxygen contained in the starting materials or in the atmosphere to form oxides, which may be the starting point of nucleation. Specifically, the alloy, when melted completely, is preferably left to stand for a while in the melting furnace to allow the rare earth oxides to float as slag, which is then removed.

When alloy flakes are produced by conventional molding, the crystal grains may be grown to an average size of about 150 to 200 μm, but the average interval r between the R-rich regions becomes as wide as 20 μm, and cannot be limited to 1 to 10 μm. The molding also has another problem of inevitable formation of coarse α-Fe.

In the production of the referential alloy flakes, after the cooling on the roll and before the flakes are cooled to the room temperature, a heat treatment may be performed by heating the flakes or holding the flakes at a constant temperature. However, if the heat treatment is effected at too high a temperature or for too long a period, the average interval r between the R-rich regions becomes too large, or the R-rich region may segregate, to lower the magnetic properties. Alternatively, the heat treatment may be effected by heating the alloy flakes after the flakes are cooled to a near room temperature.

The referential alloy flakes may be produced into a rare earth sintered magnet by pulverizing, compacting, sintering, and ageing raw material alloy flakes containing the referential alloy flakes. The above steps may be carried out in accordance with conventional methods.

The pulverizing, compacting, sintering, and ageing may be carried out in the same way as discussed above.

Referential Example 1

Neodymium metal, ferroboron, and iron were mixed so that the alloy had a composition of 31.5 mass % neodymium, 1.04 mass % boron, and the balance iron, and melted in a high frequency induction furnace in an argon atmosphere. The alloy, when completely melted, was left to stand for a while to allow neodymium oxide to float as slag, which was then removed.

The obtained alloy melt at a temperature of 1500° C. was supplied to a single roll by strip casting and cooled at a surface velocity as shown in Table 1 to prepare alloy flakes of 0.2 mm thick. Here, a tundish made of refractory ceramics was used. The roll made of iron had been adjusted to have an Ra of 1 μm.

The average crystal grain size, the average interval r between the R-rich regions, and the total volume ratio of chill crystals and fine microstructures of the obtained alloy flakes were measured. The results are shown in Table 1.

The alloy flakes were then coarsely pulverized by hydrogenation and dehydrogenation, and finely pulverized in a jet mill, to obtain powder particles of an average particle size of about 5 μm. The powder particles were compacted in a magnetic field of 15 kOe under the pressure of 2.5 ton/cm$^2$. The resulting compacted product was sintered in vacuum at 1050° C. for 2 hours, and aged at 570° C. for 1 hour. The magnetic properties (magnetic remanence, coercivity, and maximum energy product) of the obtained sintered magnet are shown in Table 1.

Referential Examples 2 and 3

Alloy flakes and a sintered magnet were prepared in the same way as in Referential Example 1, and subjected to the measurements, except that the thickness of the alloy flakes was 0.3 mm or 0.4 mm. The results are shown in Table 1. Micrographs of the structure of the alloy flakes prepared in Referential Example 3 observed under an optical microscope and a polarization microscope in a cross section taken in the direction of its thickness at right angles to the transfer of the alloy flakes separated from the cooling roll (C-section with respect to the direction of rotation of the roll) are shown in FIGS. 12 and 13, respectively.

Referential Comparative Examples 1 and 2

Alloy flakes and a sintered magnet were prepared in the same way as in Referential Example 1, and subjected to the measurements, except that the molten alloy was not left to stand, the slag was not removed, the tundish was not preheated, a copper roll having an Ra of 7 μm was used, and the thickness of the alloy flakes was 0.2 mm or 0.7 mm. The results are shown in Table 1. Micrographs of the structure of the alloy flakes prepared in Referential Comparative Example 1 observed under an optical microscope and a polarization microscope in a cross section taken in the direction of its thickness at right angles to the transfer of the alloy flakes separated from the cooling roll (C-section with respect to the direction of rotation of the roll) are shown in FIGS. 14 and 15, respectively.

Referential Comparative Example 3

The alloy melt prepared in Referential Example 1 was poured into a book mold to prepare an ingot in the form of a plate of 10 mm thick. In the obtained alloy was observed precipitate of coarse α-Fe from the side in contact with the mold. Since α-Fe was believed to have an adverse impact on magnetic properties, a magnet was not produced from this alloy. The alloy was subjected to the same measurements as in Referential Example 1. The results are shown in Table 1.

TABLE 1

| | Surface velocity (m/s) | Average crystal grain size (μm) | Average interval r (μm) | Thickness (nm) | Magnetic remanence (kG) | Coercivity (kOe) | Maximum energy product BHmax (MGOe) |
|---|---|---|---|---|---|---|---|
| Referential Example 1 | 1.0 | 55 | 4.2 | 0.2 | 13.0 | 8.8 | 40.5 |
| Referential Example 2 | 0.5 | 72 | 4.9 | 0.3 | 13.2 | 8.6 | 42.4 |
| Referential Example 3 | 0.3 | 91 | 5.8 | 0.4 | 13.5 | 8.3 | 44.3 |
| Referential Comparative Example 1 | 1.0 | 29 | 3.6 | 0.2 | 12.6 | 8.9 | 36.5 |
| Referential Comparative Example 2 | 0.3 | 38 | 6.7 | 0.7 | 12.9 | 8.1 | 39.1 |
| Referential Comparative Example 3 | — | 197 | 32 | 10 | — | — | — |

EXAMPLES

The present invention will now be explained in more detail with reference to Examples and Comparative Examples, which do not intend to limit the present invention.

Example 1

Neodymium metal, ferroboron, and iron were mixed so that the alloy had a composition of 31.5 mass % neodymium, 1.0 mass % boron, and the balance iron, and melted in a high frequency induction furnace in an argon atmosphere.

The resulting alloy melt at a temperature of 1500° C. was supplied via a tundish to a single roll by strip casting and cooled and solidified at a surface velocity of 0.8 m/sec to prepare alloy flakes of 0.3 to 0.4 mm thick. The cooling roll used here was made of pure copper, and had a surface pattern as shown in FIG. 4, wherein the nucleating portions in the form of projections and the nucleation inhibiting portions in the form of concaves were formed uniformly, linearly, and continuously in the direction of rotation and had a cross sectional shape as shown in FIG. 2. The tops of the peaks in the cross section function as the linear nucleating portions, whereas the troughs retained the atmospheric argon gas to function as the linear nucleation inhibiting portions. The distance between the peaks, i.e. the width of the concaves was 105 μm. The depth of the concaves measured from the top of the peaks was 200 μm. The width of the top of the peaks forming the nucleating portions was not larger than 5 μm.

The obtained alloy flakes were coarsely pulverized by hydrogenation and dehydrogenation, and finely pulverized in a jet mill, to obtain powder particles of an average particle size of about 5 μm. The powder particles were compacted in a magnetic field of 15 kOe under the pressure of 2.5 ton/cm$^2$. The resulting compacted product was sintered in vacuum at 1050° C. for 2 hours, and aged at 570° C. for 1 hour.

The average interval between the R-rich regions, average crystal grain size, volume ratio of the dendrites of the 2-14-1 phase, and volume ratio of chill crystals of the obtained alloy flakes, the magnetic remanence, coercivity, and maximum energy product of the obtained sintered magnet, the feature of the cooling roll used, and the width of the nucleation inhibiting portions are shown in Table 2. Micrographs of the structure of the alloy flakes observed under an optical microscope and a polarization microscope in a cross section taken in the direction of its thickness at right angles to the transfer of the alloy flakes separated from the cooling roll (C-section with respect to the direction of rotation of the roll) are shown in FIGS. 8 and 9, respectively.

Examples 2 to 4

Alloy flakes and a sintered magnet were prepared in the same way as in Example 1, and subjected to the measurements, except that the cooling roll was replaced with the one shown in Table 2. The results are shown in Table 2.

Example 5

Alloy flakes and a sintered magnet were prepared in the same way as in Example 1, and subjected to the measurements, except that the cooling roll was replaced with a cooling roll having the same surface configuration as in Example 1 wherein, though, the nucleating portions were made of pure copper, and the nucleation inhibiting portions were made by thermal spraying a tungsten carbide-nickel composite material (67 W/mK). The results are shown in Table 2.

Example 6

On a cooling roll made of pure copper, the nucleating portions in the form of continuous linear projections at an angle of 45° with respect to the direction of rotation, and the nucleation inhibiting portions in the form of linear concaves were formed by engraving grooves with a turning tool. The distance between the projections was 300 μm, and the depth of the concaves from the top of the projections was 150 μm.

Subsequently, grooves were formed in the same width and depth as those of the above grooves, at an angle of −45° with respect to the direction of rotation (at right angles to the above mentioned grooves), to produce a cooling roll having a surface pattern of the nucleating portions and the nucleation inhibiting portions as shown in FIG. 7. Here, the dots as the nucleating portions had a minimum transverse size of 30 μm. Alloy flakes and a sintered magnet were prepared in the same way as in Example 1, and subjected to the measurements, except that the cooling roll was replaced with this cooling roll. The results are shown in Table 2.

Comparative Example 1

Alloy flakes and a sintered magnet were prepared in the same way as in Example 1, and subjected to the measurements, except that the cooling roll was replaced with a cooling roll made of pure copper of which roll surface had been polished with a #150 abrasive paper. The results are shown in Table 2. The ten-point mean roughness of the cooling roll was 8.6 μm. Micrographs of the structure of the obtained alloy flakes observed under an optical microscope and a polarization microscope in a cross section taken in the direction of its thickness at right angles to the transfer of the alloy flakes separated from the cooling roll (C-section with respect to the direction of rotation of the roll) are shown in FIGS. 10 and 11, respectively.

Comparative Examples 2 and 3

Alloy flakes and a sintered magnet were prepared in the same way as in Example 1, and subjected to the measurements, except that the cooling roll was replaced with the one shown in Table 2. The results are shown in Table 2.

TABLE 2

| | Material of cooling section | State in the bottom of inhibiting portions | Width of inhibiting portions (μm) | Depth of inhibiting portions (μm) | Width of nucleating portions (μm) | Content of dendrites (vol %) | Content of chill crystals (vol %) | Average interval between R-rich region (μm) | Average crystal grain size (μm) | Magnetic remanence (kG) | Coercivity (kOe) | Maximum energy product BHmax (MGOe) |
|---|---|---|---|---|---|---|---|---|---|---|---|---|
| Ex. 1 | copper | argon gas | 105 | 200 | ≦5 | 91.9 | 1.04 | 4.88 | 42.2 | 13.18 | 9.52 | 41.88 |
| Ex. 2 | copper | argon gas | 120 | 200 | ≦5 | 92.6 | 0.86 | 5.02 | 51.3 | 13.22 | 9.52 | 41.95 |
| Ex. 3 | copper | argon gas | 250 | 200 | ≦5 | 95.0 | 0.00 | 6.23 | 73.3 | 13.26 | 9.51 | 42.00 |
| Ex. 4 | copper | argon gas | 500 | 200 | ≦5 | 95.0 | 0.00 | 7.78 | 91.3 | 13.32 | 9.50 | 42.23 |
| Ex. 5 | copper | WC composite material | 500 | 200 | 20 | 96.0 | 0.00 | 6.31 | 88.0 | 13.29 | 9.51 | 42.13 |
| Ex. 6 | copper | argon gas | 300 | 150 | 30 | 96.0 | 0.00 | 8.82 | 89.5 | 13.28 | 9.48 | 42.10 |
| Comp. Ex. 1 | copper | none | — | — | — | 86.5 | 1.75 | 3.98 | 23.6 | 13.12 | 9.52 | 40.35 |
| Comp. Ex. 2 | copper | argon gas | 500 | 20 | ≦5 | 87.5 | 1.45 | 4.05 | 25.2 | 13.08 | 9.52 | 40.28 |
| Comp. Ex. 3 | copper | argon gas | 20 | 200 | ≦5 | 90.8 | 1.20 | 4.12 | 32.2 | 13.10 | 9.50 | 40.30 |

Inhibiting portions: Nucleation inhibiting portions

WC: tungsten carbide The width of the nucleating portions in Example 6 is the minimum transverse size of dots.

What is claimed is:

1. Alloy flakes for a rare earth sintered magnet, said alloy flakes having a composition consisting of 27.0 to 33.0 mass % of at least one element R selected from the group consisting of rare earth metal elements including yttrium, 0.94 to 1.30 mass % of boron, and the balance of at least one element M selected from the group consisting of transition metals, silicon, carbon, and mixtures thereof, with iron being essential, and an alloy structure comprising R-rich regions and dendrites of an $R_2Fe_{14}B$ phase, wherein an average interval r between said R-rich regions is 1 to 10 μm, and an average size of crystal grains in the alloy structure is larger than (6r+2.74x−65) μm and not smaller than 40 μm, wherein r stands for an average interval between said R-rich regions, and x stands for a content of R in mass %.

2. The alloy flakes for a rare earth sintered magnet according to claim 1, wherein said alloy structure further comprises not more than 5 vol % of α-Fe phase.

3. The alloy flakes for a rare earth sintered magnet according to claim 1, wherein said alloy structure further comprises not more than 5 vol % of chill crystals.

4. A rare earth sintered magnet obtained by pulverizing, compacting, sintering, and ageing raw material alloy flakes containing the alloy flakes for a rare earth sintered magnet of claim 1.

* * * * *